United States Patent [19]

Öttl et al.

[11] 4,000,730

[45] Jan. 4, 1977

[54] VALVE CAGE STRUCTURE FOR INTERNAL COMBUSTION ENGINES, PARTICULARLY ADAPTED FOR FLUID COOLING

[75] Inventors: Adolf Öttl, Stadtbergen; Fredy Dost; Otto Breindl, both of Augsburg, all of Germany

[73] Assignee: Maschinenfabrik Augsburg-Nuremberg Aktiengesellschaft (M.A.N.), Augsburg, Germany

[22] Filed: Feb. 21, 1975

[21] Appl. No.: 551,619

[30] Foreign Application Priority Data

Mar. 7, 1974 Germany ..... 2410893

[52] U.S. Cl. ..... 123/189; 123/41.15; 123/41.85

[51] Int. Cl.[2] ..... F01L 3/00

[58] Field of Search ..... 123/41.15, 41.52, 41.76, 123/41.77, 41.79, 41.82, 41.85, 189

[56] References Cited

UNITED STATES PATENTS

| | | | |
|---|---|---|---|
| 566,263 | 8/1896 | Wolf | 123/41.77 |
| 3,115,125 | 12/1963 | Spencer | 123/41.77 |
| 3,115,126 | 12/1963 | Spencer | 123/41.77 |
| 3,385,053 | 5/1968 | Honda | 123/41.85 |
| 3,420,215 | 1/1969 | Seifert | 123/41.77 |
| 3,447,524 | 6/1969 | Pfleghaar | 123/189 |
| 3,742,927 | 7/1973 | Kuhn | 123/189 |

*Primary Examiner*—C. J. Husar
*Assistant Examiner*—Daniel J. O'Connor
*Attorney, Agent, or Firm*—Flynn & Frishauf

[57] ABSTRACT

To prevent differential deformation and damage, upon operation of large internal combustion engines, such as large Diesel engines, the cage structure is formed with a central valve seat and a lateral passage for inlet and exhaust gases to the cylinder of the internal combustion engine, and the wall opposite the lateral passage is formed with a diametrically interrupting slit extending at least in part transversely to the longitudinal axis of the cage (and hence of the valve), leaving a depending tongue to delimit the valve cage, the interrupted wall structure preventing unbalanced thermal and vibration stresses from interfering with the structural stability of the valve cage.

19 Claims, 4 Drawing Figures

VALVE CAGE STRUCTURE FOR INTERNAL COMBUSTION ENGINES, PARTICULARLY ADAPTED FOR FLUID COOLING

Cross reference to related patent: U.S. Pat. No. 3,719,175, March 3, 1973, LUTHER et al, assigned to the assignee of the present application.

The present invention relates to internal combustion engines and particularly to large high-power internal combustion engines, such as large Diesel engines, and especially to the valve cage structure therefore which also provides gas ducts for gases being conducted to, or from, the cylinder to which the valve cage is attached.

A valve cage of the type to which the present invention relates is known (see, for example, German Pat. No. 832,702). A valve seat is located at the side facing the combustion space of the cylinder, and a duct is provided leading laterally away from the valve seat. This duct, which may be called the charge exchange duct, has a single opening in the region of the valve seat, to which exhaust gases may be admitted, for example, and is formed with an enlarged opening, for attachment to a manifold. The arrangement is so made that the flow conditions of gas flow through the valve cage are favorable, that is, the valve cage interposes only a low pressure drop between the valve port of the cylinder and the manifold. Such a valve cage, which may also be referred to as a valve shell, due to the lateral opening thereof, has its structural material non-symmetrically located with respect to the actual exhaust opening connected to the cylinder (or, if used as an inlet valve, with respect to the inlet valve opening in the cylinder). This highly unsymmetrical distribution of structural material, that is, the metal of the valve cage or shell, results in unsymmetrical loading thereof upon axial stressing, and particularly leads to elastic deformation, resulting in non-uniform support strength between the valve cage and the seat of the cylinder cover, as well as between the valve cage and the valve seat itself. As a result, the respective valve may not seat tightly, and the conical valve seat is unduly heated. Further, the seating or placement of such valve cages is subject to a high degree of wear, decreasing the operating time of the valves, and the valve seat, as well as requiring frequent replacement of the valve cage.

It is an object of the present invention to improve the structure of a valve cage of the aforementioned type, so that deformation due to axial or thermal stresses is essentially eliminated without, however, impairing the advantages of a shell-type valve cage regarding flow of gases to, or from, a cylinder, ease of maintenance, and simplicity of manufacture.

Subject Matter of the Present Invention

Briefly, the valve cage is formed with a lateral exit opening and the wall opposite the exit opening, and delimiting the passage or chamber in the valve cage for exchanged gases is formed with an interrupting slit extending, at least in part, transversely to the longitudinal axis of the valve, and hence of the valve cage itself. This slit may be straight, or bowed upwardly, for example in U-shape, so that the wall opposite the passage or chamber forming the charge exchange passage will be tongue-shaped.

Deformation by bending or buckling of the valve cage within the region in which gases are conducted is thus effectively eliminated. The structure has the additional advantage that the various components thereof in the range of the valve seat will not heat as much as before, so that the valve and the valve seats will have a longer operating life between maintenance. The flow resistance, that is, the resistance to gas flow through the valve cage corresponds to that of the valve cage of the prior art, or is less, so that the advantages of the prior-art valve cage are retained.

The transverse slit may be joined integrally with longitudinal slits, to define the aforementioned tongue-shaped wall delimiting the charge exchange gas passage.

The transverse slit may be combined with longitudinal slits located symmetrically with respect to a plane extending through the center of the charge exchange passage of the valve cage, or of its longitudinal axis, respectively. The valve cage, preferably, is laterally defined by symmetrical supports shaped, at their outside, as circular segments which, in accordance with an advantageous further embodiment, are formed with bores, through which a cooling fluid may circulate.

The invention will be described by way of example with reference to the accompanying drawings, wherein.

Figure 1:
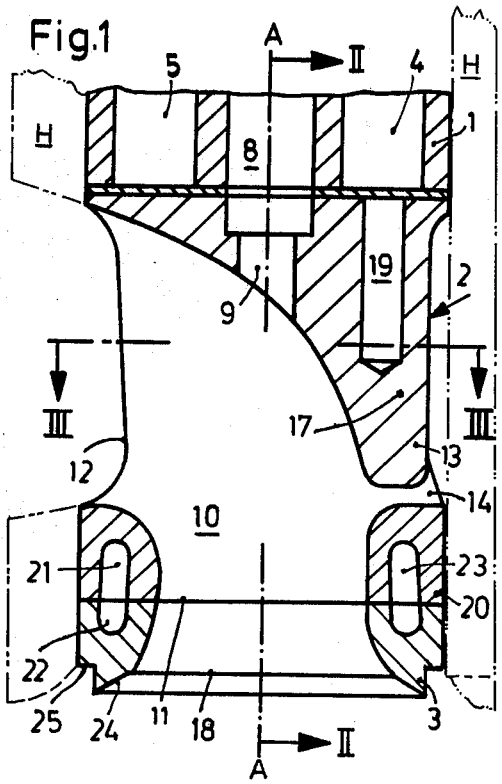
FIG. 1 is a longitudinal section through a valve cage in accordance with the present invention.
Figure 2:
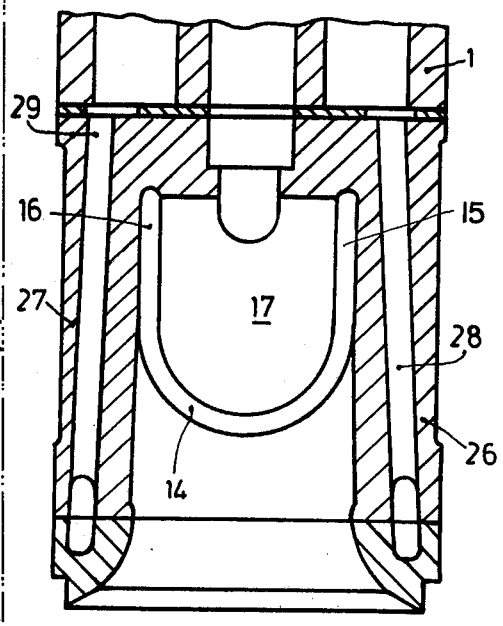
FIG. 2 is a transverse section taken along line II—II of FIG. 1.
Figure 3:
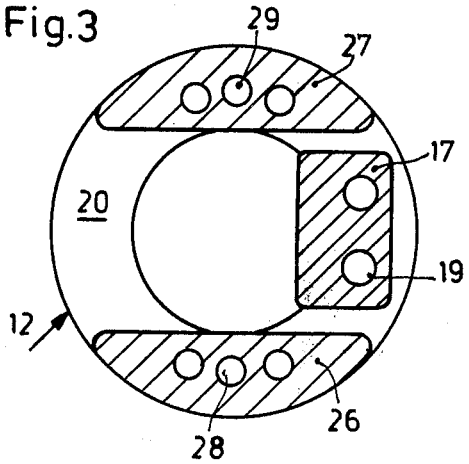
FIG. 3 is a horizontal section taken along lines III—III of FIG. 1.

The valve cage is assembled within the cylinder head H, shown only in phantom view in FIG. 1. It comprises an upper cage portion 1, a lower or central cage portion 2, and a valve seating ring portion 3. The three parts are connected together by means of vacuum hard soldering, brazing, or the like. The upper portion 1 is formed with two cooling chambers 4, 5, which are separated by separating walls. Cooling fluid is supplied to one of the chambers and removed from the other, by suitable ducts or piping, not shown. The upper portion 1 is further formed with a central bore 8 for a bushing, not further shown, which functions as a valve guide bush (not shown) through which a valve tappet or operating rod can pass. The central bore 8 extends into the central portion 2, to be then joined by a bore 9 of reduced diameter, which terminates in the charge exchange duct or chamber 10. A sealing packing, not further shown, may be located in the region of the central bore 8, or in the portion 9, to seal a valve shaft (not shown) passing through the bore 9 with respect to gases in chamber or duct 10. The charge exchange duct 10 provides for a 90° change of direction of gases flowing therethrough. It has a lateral outlet 12 which may be connected to an exhaust manifold, or to an inlet manifold for inlet air, as desired. The duct 10, at its lower portion, continues centrally of the cage. The back wall 13 opposite the outlet opening 12, and which delimits or defines the duct 10, is interrupted by a cross or transverse slit 14, extending transversely to the longitudinal axis A—A of the valve cage 10. As best seen in FIG. 2, the transverse slit 14 is integrally joined by longitudinal slits 15, 16 extending longitudinally in the direction of the axis A—A, to form a single integral U-shaped slit. This U-shaped slit defines, therefore, at its inner portion thereof, a depending tongue 17, facing in the direction of the valve seat 18. The cross slit 14 and the longitudinal slits 15, 16 have a gap width of about 5 to 15 mm; that is, are equal with respect to the opening 12 (FIGS. 1,3). They are symmetrically located with respect to the center of the outlet opening 12 of the charge exchange duct 10 and with respect to a plane which includes the longitudinal axis A—A of the valve cage and external across the wall 13 for about the same distance as opening 12. Cooling bores 19 (FIG. 3) are formed in the tongue 17 to prevent excess heating of the tongue. The ridge or ring in the lower valve portion 2 which is left, that is, which is defined by the portion below slit 14, 15, 16, and generally indicated at 20, is formed with bores or spaces 22, which are circular to form a cooling ring 23, in order to cool the valve seat 18. Valve seat 18 is formed with a conical surface 24, against which a disk-like, frusto-conical valve can seat. The valve is movable upwardly and downwardly to engage the valve seat or to be pushed away therefrom. The outer circumference of the valve seat ring 3 is formed with a ring-shaped notch 25 which engages a matching ridge in the cylinder head to properly seat the valve cage on the cylinder.

The transverse slit 14, as well as the longitudinal slits 15, 16, are best seen in FIG. 2. Two circular, segmental, symmetrical uprights 26, 27 (FIG. 3) will remain, arranged laterally of the charge exchange duct 10. The uprights 26, 27 not only define the duct 10, but provide cooling; they are formed with at least one cooling fluid bore 28, 29, which bores communicate with the ring-shaped cooling space 23 in the region of the valve seat 18 on the one hand, and with the cooling spaces 4, 5 in the upper part or portion of the valve cage on the other. The uprights 26, 27 are supported on the crown or ring portion 20 of the lower valve cage portion 2.

The formation of the slit in the valve cage separates the function of the valve cage with respect to two requirements: On the one hand, the valve cage provides for guidance of the gases between a manifold and the cylinder of the internal combustion engine, and on the other it provides an attachment structure to accept and absorb the attachment forces for the manifold, for itself, and other structural components. Mechanical stresses are transmitted through the uprights 26, 27 (FIG. 3) which are essentially uniformly loaded by the gases passing through the charge exchange duct 10. These uprights are symmetrically placed and the stress distribution therethrough, as well as the stresses which arise in the vicinity of the valve seat are essentially uniform, even considering thermal deformations. The uprights 26, 27, and the tongue-like extension 17 which is located between the symmetrical uprights 26, 27, provide for reliable guiding and directing of gases, and of the gas flow through the charge exchange duct 10. The tongue 17, as is clearly apparent from FIGS. 2 and 3, is not, however, connected to the lower ring portion 20 of the central part 2 of the cage structure. The particular arrangement avoids dead spaces outside of the region of gas flow being directed through the duct 10. The operating temperatures which arise in the structure, particularly in the region of the valve seat have been reduced, thus resulting in longer operating time of the valve, and substantial cost reduction due to substantially decreased maintenance.

The shape of the slit is not critical; it must be so placed, however, that a directional vector component thereof extends transversely to axis A—A, at least in part.

Heating of the components is further reduced by connecting the various ducts and openings to a forced cooling fluid circuit (see cross-referenced U.S. Pat. No. 3,719,175). Cooling fluid is applied from supply lines, not shown, to the chamber 4, and then through bores 28 of upright 26 into ring 23, to be taken off by bores 29 in the other upright 27 for conduction to cooling chamber 5, and subsequent removal over drain lines (not shown) from the valve cage. The cooling bores 19 in the tongue 17 likewise communicate with the chambers 4, 5. The bores 19 are supplied with cooling water which circulates by thermal convection, that is, cold cooling water will drop downwardly and warm water will be displaced upwardly.

Various changes and modifications may be made within the scope of the inventive concept; the slit may have various shapes, for example. The slit may be so arranged, for example, that the tongue 17 is directed upwardly, that is, the cross slit 14 can be located close to, or into the upper valve portion 1, to be joined by longitudinal slits 15, 16, directed towards the lower part of the portion 2, that is, towards the valve seat 18.

Figure 4:
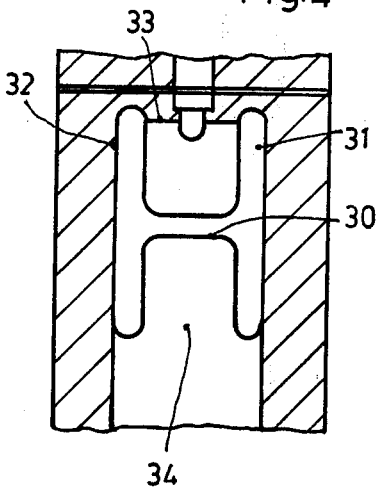
FIG. 4 is a fragmentary view similar to FIG. 2, and illustrating a different shape of transverse and longitudinal slit arrangement.

The slit may be formed, for example, as illustrated in FIG. 4. The slit is located centrally, joined by two upwardly extending slits to form, generally, an H, in which a transverse slit 30 connects with two upright slit portions 31, 32, respectively. Such an arrangement of slits results in two tongues 33, 34, the end portions of which are facing each other.

The valve cage may be made as a grey iron casting, a steel casting, or as nodulized, or spheroidal graphite cast iron; these slits may, therefore, already be cast upon casting the entire cage. Different slit arrangements are possible, and other changes and modifications may be made within the scope of the inventive concept.

Escape of toxic or noxious gases to the outside from the slit 14, is prevented by the housing structure H (omitted in FIG. 3), which encloses the valve cage.

We claim:

1. A valve cage (1, 2, 3) for combination with the cylinder of the engine, particularly for insertion in the cylinder head structure (H) thereof, said cage being formed with a valve seat (24) located centrally therein, and a charge exchange passage (10) extending along the longitudinal axis (A—A) of the cage and leading from the valve seat (24) to a lateral opening (12) to effect communication of gases between a manifold and an internal combustion engine cylinder, said cage having a back wall (13) located opposite the lateral opening (12) to delimit said passage (10), characterized by an arrangement to equalize the stresses placed on the cage during operation of the engine due to non-symmetrical location of the lateral opening (12) of the charge exchange passage with respect to the longitudinal axis (A—A) of the cage comprising a transverse slit (14,30) formed in said back wall (13) located with respect to said longitudinal axis (A—A) opposite said lateral opening (12) and extending at least in part transversely to the longitudinal axis (A—A) of the valve cage.

2. Valve cage according to claim 1, wherein at least a portion of the slit is curved, the curvature of the slit having a vector component transverse to said axis (A—A).

3. Valve cage according to claim 2, wherein at least a portion of the slit is straight and extends essentially transversely to said axis (A—A).

4. Valve cage according to claim 1, wherein said wall (13) opposite the lateral opening (12) is additionally formed with longitudinal slits (15, 16; 31, 32) which are joined to said interrupting slit (14, 30) to define a tongue-shaped projection (17, 34) located between said slits.

5. Valve cage according to claim 2, wherein said slits (14, 15, 16) are located symmetrically with respect to a plane passing centrally through the lateral opening (12) and the longitudinal axis (A—A) of the cage structure.

6. Valve cage according to claim 4, wherein the tongue-shaped projection (17) projects towards the valve seat (18, 24).

7. Valve cage according to claim 2, wherein the tongue-like projection (34) has at least a portion projecting towards the upper portion (1) of the cage.

8. Valve cage according to claim 4, wherein the slits are joined to form a generally U-shaped slit.

9. Valve cage according to claim 4, wherein the slits are joined to form a generally H-shaped slit, the delimiting wall (13) forming two tongue-shaped projections (33, 34).

10. Valve cage according to claim 9, wherein said tongue-shaped projections (33, 34) face each other.

11. Valve cage according to claim 1, wherein the lateral portions of the cage, and laterally of the slit, form similar stress-bearing uprights (26, 27).

12. Valve cage according to claim 11, wherein the uprights (26, 27) at their inner surface define said duct (10) and at the outer surface are part-circular.

13. Valve cage according to claim 1, wherein the slit has a width of between about ½ and 1½ cm.

14. Valve cage according to claim 2, further comprising cooling fluid supply bores (19) formed in the tongue-shaped projection (17).

15. Valve cage according to claim 11, further comprising cooling fluid bores (28, 29) formed in the uprights (26, 27);

and an essentially ring-shaped cooling duct (23) formed in the valve cage and located adjacent the valve seat (18, 24), said cooling ring (23) being in communication with the cooling bores (28, 29) in the uprights.

16. Valve cage according to claim 1, in combination with an internal combustion engine having a cylinder head structure (H) formed with an essentially circular bore, the outer surface of said cage being of circular outline and fitting in the bore of said cylinder head structure, the inner bore wall of said cylinder head structure (H) blocking escape of gases passing through said slit (14).

17. Valve cage according to claim 1, wherein said slit (14,30) has a lateral extent at a right angle to said axis (A—A) approximately equal to the lateral extent at a right angle to said axis of said lateral opening (20).

18. Valve cage according to claim 1, wherein the width of the slit is small with respect to the diameter of the lateral opening (12).

19. Valve cage according to claim 1, wherein said slit (14,30) separates the cage into two similar stress bearing uprights (26,27) of substantially similar cross-section adjacent said opening (12) and adjacent the region of said slit (14,30) in the back wall (13), the slit having a width which is small with respect to the diameter of the opening (12) so that forces transferred through the cage cannot transfer through said back wall (13) due to the presence of said slit (14,30) but will be transferred through said uprights while providing a single lateral flow opening for communication of gases in essentially non-turbulent flow.

* * * * *